United States Patent [19]

Petersen et al.

[11] 4,314,806

[45] * Feb. 9, 1982

[54] TEXTILE FINISH AND PROCESSES FOR ITS PREPARATION AND USE

[75] Inventors: Harro Petersen, Frankenthal, Fed. Rep. of Germany; Panemangalore S. Pai; Manfred Reichert, both of Charlotte, N.C.

[73] Assignee: BASF Aktiengesellschaft, Fed. Rep. of Germany

[ * ] Notice: The portion of the term of this patent subsequent to Jun. 10, 1997, has been disclaimed.

[21] Appl. No.: 184,814

[22] Filed: Sep. 8, 1980

[51] Int. Cl.[3] ..... D06M 15/54

[52] U.S. Cl. ..... 8/187; 8/185; 260/29.4 R

[58] Field of Search ..... 8/187; 260/29.4 R

[56] References Cited

U.S. PATENT DOCUMENTS

| | | | |
|---|---|---|---|
| 3,369,858 | 2/1968 | Lourigan et al. | 8/187 |
| 3,622,261 | 11/1971 | Cotton et al. | 8/187 |
| 3,871,822 | 3/1975 | Goodman et al. | 8/187 |
| 4,207,073 | 6/1980 | Petersen | 8/187 |

FOREIGN PATENT DOCUMENTS

| | | | |
|---|---|---|---|
| 1123677 | 8/1968 | United Kingdom | 8/187 |

*Primary Examiner*—Maria Parrish Tungol
*Attorney, Agent, or Firm*—Keil & Witherspoon

[57] ABSTRACT

A process for the preparation of a textile finish, the finish thus obtained and its use for the easycare finishing of textiles containing, or consisting of, cellulose. The finish comprises an aqueous solution, of from 30 to 70 percent strength by weight, of a mixture of the conventionally methyloloated(=hydroxymethylated) carbamates I and II

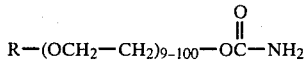

I

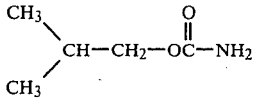

II where R is hydrogen or alkyl of 1 to 4 carbon atoms, in the weight ratio I:II of from 1:1 to 1:20. The finish is prepared by reacting a glycol or an alkylglycol of the formula III $$R-(OCH_2-CH_2)_{9-100}-OH \qquad \text{III}$$

where R has the above meanings, and isobutanol with urea at above 100° C., so as to eliminate ammonia and produce carbamates, and methylolation with formaldehyde. In a first stage, the glycol or alkylglycol of the formula III is reacted to the extent of at least 50% with urea, in the absence of a catalyst, at from 130 to 160° C., to give the carbamate I, and in a second stage, carried out either in the presence of an ion exchanger containing nickel ions at from 130° to 165° C., or in the absence of a catalyst at from 150° to 200° C., the carbamate mixture in the weight ratio I:II of from 1:1 to 1:20 is prepared by addition of isobutanol and further urea.

3 Claims, No Drawings

TEXTILE FINISH AND PROCESSES FOR ITS PREPARATION AND USE

U.S. Pat. No. 4,207,073 (Ser. No. 000815) discloses an easy-care finish for textiles containing, or consisting of, cellulose, which finish consists of a mixture of methylolated carbamates of polyethylene glycols which may be etherified at one chain end with a lower alcohol, and mono- or oligoalkylene glycols which may be etherified in the same manner on one side, in specific relative proportions. This finish has outstanding properties, but its reactivity leaves something to be desired.

It is an object of the present invention to provide a finish of the said type having similar properties but higher reactivity.

We have found that this object is achieved by the process claimed in claim 2. The finishes thus obtainable are not only colorless or almost colorless, but also exhibit the following very important properties: good shelf life of the neutral solution and stability in an acid bath, coupled with a significantly improved reactivity as compared with the above-mentioned finish; high resistance to chlorine and hydrolysis after application to the textile; good abrasion resistance; a pleasant textile hand; low soiling; little elimination of formaldehyde. Textiles finished therewith can be printed very easily. The combination of improved reactivity and all the above excellent properties, virtually without any disadvantages, makes the finish according to the invention a most valuable product.

To carry out the first stage of the reaction, about equimolar amounts (any excess of one or the other component can be compensated in the second stage) of urea and polyethylene glycol III (of which one chain end may be etherified with methanol, ethanol, propanol or butanol, though the free polyethylene glycol, i.e. with both chain ends non-etherified, is preferred) of degree of polymerization from 9 to 100, preferably from 9 to 20, are heated in the absence of a catalyst, in a stream of inert gas for the purpose of excluding air and removing the ammonia formed, for several hours (from about 2 to 7 hours, preferably from 3 to 6 hours) at from 130° to 160° C., preferably from 145° to 155° C., whilst stirring. The reaction can be carried out under atmospheric or superatmospheric pressure, continuously or batchwise, with or, preferably, without a solvent. Suitable solvents are relatively high-boiling organic liquids which are inert under the reaction conditions, for example aromatic or araliphatic hydrocarbons, e.g. toluene, xylene, ethylbenzene, isopropylbenzene or mixtures of these. After the reaction, any solvent is distilled off.

The reaction takes place in accordance with the equation

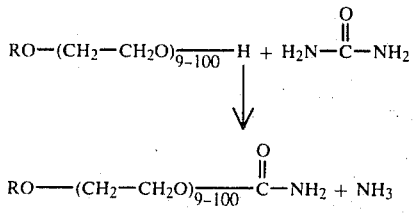

If R is H, the reaction of course does not take place entirely in accordance with the above idealized scheme; instead, dicarbamates are also formed, by reaction of both hydroxyl end groups of the polyethylene glycol, whilst some of the glycol does not react at all. However, this is immaterial for the purposes of the present invention and will therefore be disregarded in the text which follows, i.e. the term "monocarbamate" will be used though the actual reaction mixture is meant.

When this reaction has taken place to the extent of at least 50%, preferably at least 65%, in particular more than 80% (in the case where R is H, 100% is taken to mean the reaction of an average of one of the two hydroxyl groups of the polyethylene glycol; the degree of conversion can be determined from, for example, the residual urea content), the second stage can be started, in which an analogous reaction takes place and the first reaction may or may not be completed.

To carry out the second stage, further urea, the isobutanol and the catalyst, if any, are added to the reaction mixture, whilst stirring, and heating of the mixture is continued, advantageously whilst also continuing to pass a stream of inert gas under atmospheric pressure, or under a pressure of up to about 5 bar, for from 2 to 40 hours, preferably from 5 to 20 hours, at from 130° to 165° C., especially from 145° to 155° C., in the presence of a catalyst, or at from 150° to 200° C., especially from 160° to 190° C., in the absence of a catalyst, the lower temperature in each case corresponding to a longer reaction time, and vice versa. The reaction temperature is only of importance inasmuch as discoloration must be expected at excessively high temperatures, whilst at excessively low temperatures the reaction time increases disproportionately. The molar ratio of isobutanol to urea employed in the 2nd stage is from 4:1 to 1:1, preferably about 2:1. If the ratio used is 1:<1, the excess of isobutanol is subsequently distilled off.

The catalyst advantageously employed in the 2nd stage consists of an ion exchanger, as a rule an acidic ion exchanger, preferably an acidic synthetic resin exchanger, which contains nickel ions. Such exchangers are described, for example, in Houben-Weyl, Methoden der Organischen Chemie, Volume I/1, page 528, Table 3. Preferably, exchangers of high or medium acidity are employed, for example phenolsulfonic acid resins or polystyrenesulfonic acid resins, or exchangers containing corresponding acidic resins, for example bifunctional condensation resins. It is also possible to use styrenephosphonic acid resins, styrenephosphinic acid resins, resorcinol resins and aliphatic or aromatic carboxylic acid resins. Numerous versions of the above cation exchangers are commercially available. Before the reaction, the exchanger is charged with nickel by conventional methods, advantageously by treatment with a solution, preferably an aqueous solution, of a nickel salt. Preferred nickel salts are nickel chloride, nickel acetate, nickel bromide, nickel nitrate and especially nickel sulfate. The nickel compounds may also be in the form of the hydrates, for example nickel chloride hexahydrate. It is also possible to use, for example, nickel phosphate, nickel carbonate, nickel bicarbonate, nickel borate, nickel oxalate or nickel propionate. Advantageously, the exchanger is activated, before treatment with the nickel salt, with an acid, preferably sulfuric acid or the acid corresponding to the anion of the nickel salt. Advantageously, the exchanger is first kept under water, or in water, at from 15° to 40° C. for from 10 to 30 minutes, is then activated for from 10 to 60 minutes with an acid, advantageously in the form of an aqueous solution of from 2 to 15 percent strength by weight, at from 15° to 40° C., and is finally washed with water until neutral. The treatment with the nickel salt solution is advantageously carried out at from 10° to 50° C., preferably from 20° to 30° C. The reaction can be carried out batchwise under atmospheric or superatmospheric pressure, for example by a process wherein the reactants are stirred in or charged in, or preferably continuously, for example in exchanger columns, in a fixed bed, flow bed or fluidized bed, or in a tray column. Advantageously, the nickel salt solutions are of from 5 to 50 percent strength by weight, and the treatment time is from 10 to 60 minutes. It is advantageous subsequently to rinse the product with water until the wash liquor issuing from the exchanger column is neutral, after which the product is washed with one of the above inert solvents or an alcohol for from 10 to 60 minutes at from 15° to 40° C. until substantially anhydrous. Advantageously, each part by weight of exchanger is charged with from 0.01 to 0.2, preferably from 0.02 to 0.1, especially from 0.02 to 0.08, part by weight of nickel, and from 0.01 to 0.25, preferably from 0.02 to 0.1, part by weight of exchanger is used per part by weight of urea.

It is true that in principle a nickel salt may also be used as the catalyst, instead of an ion exchanger containing nickel ions, but the ion exchangers can be much more easily separated from the reaction product by filtration, or by sedimentation, than can the salts (which would have to be precipitated as the hydroxide).

It suffices if the starting materials are of technical-grade purity.

After conclusion of the second stage, the reaction mixture can be cooled to about 70° C. and the catalyst can be separated off, advantageously by filtration. Thereafter, any excess isobutanol is distilled off, if appropriate under reduced pressure.

The carbamate mixture thus obtained in then methylolated in the conventional manner in order to convert it to the desired textile finish. For this purpose, it is treated with aqueous formaldehyde solution at a pH of from 7.5 to 11, preferably from 8.5 to 10, for from one to 10, preferably from 2 to 5, hours at from 10° to 80° C., preferably from 30° to 60° C. The amount of formaldehyde in the aqueous solution is 1 to 2, preferably 1.4 to 1.8 moles per mole of carbamate. The solution is then neutralized with any water-soluble acid, for example sulfuric acid, after which it may or may not be diluted with water to the desired concentration. If necessary, the solution can be filtered, with or without the use of a filtration aid, e.g. active charcoal.

The resulting almost colorless or completely colorless clear aqueous solution is the ready-to-use textile finish. It is marketed as a concentrated solution (of from 30 to 70% strength by weight) having a pH of from 5 to 8, preferably from 6 to 7.5, and, before use, can be diluted as desired and mixed with acidic or potentially acidic catalysts and other assistants, with other finishes, or with pigments, plasticizers or the like. It is used for providing a shrink-resistant and wrinkle-resistant, and hence easy-care, finish on textiles which contain, or consist of, natural or regenerated cellulose.

The new finishes are employed in conventional manner, preferably in the form of an aqueous impregnating bath to which the catalysts generally required for the crosslinking reaction are added. Potentially acid catalysts, which are generally known, and customary, for textile finishing purposes, are particularly suitable. Examples of catalysts of this type which can be used are ammonium salts of strong acids, magnesium chloride, zinc chloride and zinc nitrate. Mixtures of two or more catalysts can also be used. The concentration of finishing agent, calculated as solids, depends, in the usual way, on the desired effect and is generally between 25 and 100 g/l. The goods being treated are impregnated with the impregnating liquor in the usual way, preferably in a padder. The impregnated goods are freed from excess impregnating liquid in a known manner, for example by squeezing out. The rate of application of the condensate, calculated as solids, to the fabric is governed by the effect required and is usually from 3 to 12, preferably from 5 to 8% by weight of the dry weight of the textile. It is possible to dry the impregnated fibrous goods to a greater or lesser extent and then heat them to a temperature of 100° to 230° C., preferably 130° to 180° C., in the presence of the acid or potentially acid catalysts. In general, fixing is complete after 1 to 6 minutes under these conditions. It is possible mechanically to shape the fibrous goods during or after drying before fixing, for example by compression, crimping, ironing, calendering, embossing or pleating. Cellulosic textiles are given a durable crease-resist and shrink-resist finish in this way and the embossed effects and pleats are relatively resistant to laundering.

The previously used hydroxymethyl or alkoxymethyl compounds containing nitrogen, as well as finishing agents not containing nitrogen, can be used conjointly with the new agents. It is also possible to use, conjointly, the customary water repellents, softeners, levelling agents, wetting agents, etc., such as, in particular, polymer solutions or dispersions. Examples of water repellents are paraffin wax emulsions containing aluminum or zirconium, preparations containing silicones, and perfluorinated aliphatic compounds. Softeners which may be mentioned are oxyethylation products of higher fatty acids, fatty alcohols or fatty acid amides, high molecular weight polyglycol ethers, higher fatty acids, fatty alcohol sulfonates, N-stearyl-N',N'-ethylideneurea and stearylamidomethylpyridinium chloride. Examples of levelling agents which can be used are water-soluble salts of acid esters of polybasic acids with ethylene oxide adducts or propylene oxide adducts of long-chain basic starting materials which can be oxyalkylated. Examples of wetting agents are salts of alkylnaphthalene-sulfonic acids, the alkali metal salts of sulfonated succinic acid dioctyl ester and the adducts of alkylene oxides to fatty alcohols, alkylphenols, fatty amines and the like. Examples of finishes which can be used are cellulose ethers or cellulose esters and alginates, and also solutions or dispersions of synthetic polymers and polycondensates, for example of polyethylene, polyamides, oxyethylated polyamides, polyvinyl ethers, polyvinyl alcohols, polyacrylic acid or its esters and amides and corresponding polymethacrylic compounds, polyvinylpropionate, polyvinylpyrrolidone and copolymers, for example those of vinyl chloride and acrylates, of butadiene and styrene or acrylonitrile, of vinylidene chloride or $\beta$-chloroalkylacrylates or vinyl ethyl ether as the first component and the amides of acrylic, crotonic or maleic acid as the second component, or of N-methylolmethacrylamide and other polymerizable compounds. These additional auxiliaries are in general employed in amounts of 0.3 to 4%, preferably 1 to 2.5%, relative to the weight of the dry textile goods; in special cases, these amounts can be exceeded.

The parts and percentages mentioned in the Examples which follow are units by weight.

EXAMPLE 1

A mixture of 203 parts of polyethylene ether diol having a molecular weight of 810 ($H(OCH_2CH_2)_{18}OH$) and 15 parts of urea was kept in a stirred apparatus equipped with a reflux condenser and gas inlet tube for three hours at 145° C. whilst stirring and passing a stream of nitrogen through. After this time the conversion was 65% (measured by determining the residual urea content). 1840 parts of isobutanol, 600 parts of urea and 50 parts of a commercial cation exchanger which had been treated with a nickel salt as described in U.S. Pat. No. 4,207,073 (Ser. No. 000,815/79) were then added. The reaction mixture was refluxed under a pressure between 2 and 2.5 bar for 15 hours at 150° C. whilst stirring and passing a stream of nitrogen through the apparatus. The reaction solution was then cooled to 80° C. and the exchanger filtered off. The excess of isobutanol was distilled off. 1300 parts of a co-carbamate were obtained. This corresponds to a yield of 94% of theory. The residual urea content was 0.5%. The co-carbamate was methylolated in a conventional manner by treating it for 3 hours at 50° C. with 1200 parts of a 40% aqueous solution of formaldehyde at a pH of 9 to 10, which was adjusted with NaOH. Finally the pH was adjusted to 6.5 with $H_2SO_4$. The solution was diluted with water to a 40% solids content.

EXAMPLE 2

The padding solutions were applied to 50/50 polyester/cotton sheeting fabric (108 g/m$^2$) by immersing the fabric in the solution and padding so that the fabric retained a weight of solution equal to 50–60% of its dry weight. The most suitable acidic catalyst was employed in each case. In addition to the actual finish and catalyst, the treating baths also contained other auxiliary agents commonly used in textile finishing. For instance non-ionic wetting agents were used to accelerate impregnation. Softening agents modified the hand of the fabric.

The wet fabric was dried and cured between 163° to 205° C. for 20 seconds.

The following five pad bath formulations were prepared to illustrate the invention (a) as compared with some of the best finishes known in the art (b to e):

(a)
- 10.00% of a 40% aqueous solution of the co-carbamate resin of the invention as described in Example 1
- 0.10% commercial non-ionic wetting agent on the basis of oxyethylated nonylphenol
- 2.00% commercial non-ionic polyethylene emulsion softener
- 3.00% activated magnesium chloride catalyst
- 0.1–0.15% commercial optical brightener (b)
- 10.00% of a 40% aqueous solution of a methylolated co-carbamate described in Example 1 of U.S. Pat. No. 4,207,073 (Ser. No. 000,815/79)
- 0.10% commercial non-ionic wetting agent on the basis of oxyethylated nonylphenol
- 2.00% commercial non-ionic polyethylene emulsion softener
- 3.00% activated magnesium chloride catalyst
- 0.1–0.15% commercial optical brightener (c)
- 10.00% of a 45% aqueous solution of dimethylol 2-methoxy ethyl carbamate
- 0.10% commercial non-ionic wetting agent as in formulation (a)
- 2.00% commercial non-ionic polyethylene emulsion softener
- 3.00% activated magnesium chloride catalyst
- 0.15% commercial optical brightener
- Balance tap water, ambient temperature.

(d)
- 10.00% of 40% aqueous solution of dimethylol 4,5-dihydroxyethyleneurea resin
- 0.10% non-ionic wetting agent in formulation (a)
- 2.00% commercial non-ionic polyethylene emulsion softener
- 2.00% zinc nitrate hexahydrate
- 0.15% commercial optical brightener
- Balance tap water, ambient temperature.

(e)
- 10.00% of a 40% aqueous solution of dimethylol 4,5-dihydroxyethyleneurea resin
- 0.10% commercial non-ionic wetting agent as in formulation (a)
- 2.00% commercial 35% aqueous anionic emulsion of dimethyl polysiloxane
- 0.10% glacial acetic acid
- 0.20% Dow Corning T4-0149 crosslinker additive
- 2.00% zinc nitrate hexahydrate
- Balance tap water, ambient temperature.

Except in the case of Table VIII, the fabric swatches were dried and cured at 200° C. for 20 seconds.

Durable press (DP) ratings were measured by AATCC Test Method 124–1975—i.e., machine wash and tumble dry. Table 1 shows the DP properties of the finished fabrics from finish bath treatments (a), (b), (c), (d) and (e).

TABLE I

D.P. properties of 50/50 polyester/cotton sheeting cloth

| Pad bath | D.P. rating After 1 home laundering | After 5 home launderings |
|---|---|---|
| (a) | 4.0 | 4.0 |
| (b) | 3.8 | 3.7 |
| (c) | 3.7 | 3.8 |
| (d) | 4.0 | 3.9 |
| (e) | 4.0 | 4.1 |

From the above data it can be seen that the co-carbamate resin of the invention (a) shows as high durable press ratings as the methylolated carbamate mixture (b) and the dimethylol dihydroxyethyleneurea DHEU (d) and (e), whereas the conventional dimethylol methoxyethyl carbamate (c) shows a relatively small decrease in DP ratings.

The resistance of the treated fabrics to discoloration due to scorching at 180±1° C. for 30 seconds after an accelerated test (AATCC Test Method 92-1974) to determine the potential damage caused by retained chlorine was visually evaluated. The results are shown below (Table II).

TABLE II

| Pad bath | Resistance to scorching after 1 and 5 home launderings |
|---|---|
| (a) | Excellent (no discoloration) |
| (b) | Excellent (no discoloration) |
| (c) | Excellent (no discoloration) |
| (d) | Fair (slight discoloration) marginal acceptance |
| (e) | Fair (slight discoloration) marginal acceptance |

The co-carbamate resin of the invention (a) shows a much greater resistance to chlorine retention than dimethylol DHEU (d and e) and the same resistance as the methylolated carbamates (b and c).

The finished fabrics were tested for free formaldehyde content in accordance with AATCC Test Method 112-1975. The results are shown in Table III:

TABLE III

| Pad bath | Content of free formaldehyde |
|---|---|
| (a) | 145 ppm |
| (b) | 160 ppm |
| (c) | 360 ppm |
| (d) | 525 ppm |
| (e) | 475 ppm |

From the above table it is evident that the co-carbamate resin of the invention (a) liberated less formaldehyde than other resin types except (b). The textile fabrics with a reduced free formaldehyde content are highly beneficial in safeguarding the health of garment industry employees and ultimately the consumers.

Dimensional changes (shrinkage) in automatic home laundering of durable press woven fabrics were measured by AATCC Test Method 135-1973. Shrinkage of both length (wrap) and width (fill) is reported in Table IV. The shrinkage values were mainly influenced by the type of resin used.

TABLE IV

| | % shrinkage (W × F) | |
|---|---|---|
| Pad bath | After 1 home laundering | After 5 homelaunderings |
| (a) | 0.8 × 0.4 | 1.05 × 0.6 |
| (b) | 0.9 × 0.5 | 1.1 × 0.8 |
| (c) | 1.0 × 0.6 | 1.55 × 0.9 |
| (d) | 0.8 × 0.3 | 1.0 × 0.5 |
| (e) | 0.75 × 0.3 | 1.0 × 0.4 |

It can be seen that the co-carbamate resin of the invention (a) imparts a high level of shrink resistance to the textile fabric as do the methylolated carbamate mixture (b) and the conventional dimethylol dihydroxyethyleneurea (d+e), whereas the conventional dimethylol methoxyethyl carbamate (c) shows a slightly higher shrinkage value than the co-carbamate.

The finished polyester/cotton blend fabrics were subjected to Accelerotor abrasion. At least 5 specimens of each fabric were abraded in an Accelerotor at 3000 rpm for 1 minute (AATCC Test Method 93-1974). The average abrasion loss results are reported in Table V.

TABLE V

| Pad bath | Abrasion loss |
|---|---|
| (a) | 3.20% |
| (b) | 3.2% |
| (c) | 2.95% |
| (d) | 10.60% |
| (e) | 6.22% |
| no finish | 1.9% |

As may be seen from the above data, the product of the invention has a lower abrasion loss than the conventional dimethylol DHEU (d+e) and about the same as the methylolated carbamates (b and c). In actual practice, the better abrasion properties contribute to less dusting in the garment manufacturing process.

In Table VI the data concerning absorbency of the resin treated fabrics as determined by AATCC Test Method 79-1975 are shown:

TABLE VI

| Pad Bath | Absorbency Time in Seconds |
|---|---|
| (a) | 6 |
| (b) | 10 |
| (c) | 10 |
| (d) | 180+ |
| (e) | 180+ |
| Control (No finish) | 5 |

The product of this invention is considerably more absorbent or hydrophilic than the conventional dimethylol DHEU (d+e). This makes water spread over a larger area and thus evaporate more rapidly, and makes the wearing of garments more pleasant. Besides, the fabrics (a) treated with the finish according to the invention are superior to conventional dimethylol DHEU finishes in subsequent pigment printing processes where absorbency is of importance.

In the following experiments the relative ability of the finished fabrics to prevent soiling or redeposition of water-based and oil-based soils from the wash liquor is determined. The tests were conducted in accordance with the Celanese anti-soil redeposition test as described after Table VII.

The soiling of the fabrics was determined by Hunter Reflectometer Model D-40, manufactured by Hunter Associates Laboratory, Inc., Fairfax, Virginia.

The % whiteness (w) was computed from these values by means of the following formula:

$w = y + 4(z-y)$ % w = percent whiteness y = green reflectance z = blue reflectance

Data are reported in Table VII.

TABLE VII

| Pad bath | % whiteness |
|---|---|
| (a) | 71.5 |
| (b) | 71.0 |
| (c) | 71.2 |
| (d) | 35.5 |
| (e) | 10.5 |
| Control (No finish) | 72.8 |

From the above data is clear that the products (a) according to this invention exhibit a very striking effect of soil anti-redeposition in comparison to the conventional dimethylol DHEU resins (d+e). The prevention of such soiling is important in all aspects of textile washing and laundering processes.

CELANESE SOIL REDEPOSITION TEST (Fibers Technical Center, APD-EL-139A, Mar. 29, 1967) Apparatus Launderometer 60° C.

Celanese standard soil (should be mixed 60 minutes once a week).

Preparation of Standard Soil Used With Celanese APD-139A Method for Anti-Soil Redeposition Mix Soil as follows:

300 g ESSO Automatic Transmission Fluid 3 g Tar (Glidden Asphalt Roof Foundation Coating no. 26003)

5 g Bandyblack Research Clay (H. C. Spinks Clay Co., Paris, Tenn.)

5 g Tide (well ground with mortar and pestle)

Stir for 30 minutes on a high speed stirrer.

Specimens:

2 samples 15×15 cm

Fabrics are machine washed prior to testing using normal cycle according to type of material.

1. all fabrics containing wool—40° C.
2. Tricots, circular knit and prints—50° C.
3. All woven fabrics—60° C.

Procedure:

1. Prepare soiling solution—16 g/l hot water
2. Add 200 ml of soiling solution and 10 steel balls to launderometer can.
3. Place samples in can, seal and rotate 30 minutes.
4. Remove samples and rinse in cool tap water.
5. Machine wash samples in household washing machine with 50 cc commercial household surfactant using cold water—cold rinse low setting.
6. Tumble dry.

In another experiment the reactivities of the various cross-linking agents under prescribed conditions of time and temperature of dry-curing were studied. In Table VIII some comparative data which at least give some indication of the degree of curing, i.e. cross-linking of cellulose, are reported.

BASF Resin Cure Indicator solution, ready for use, assists in establishing the degree of curing of different resin types.

Procedure:

An approximately 12.5×12.5 cm swatch is taken from the resin treated material and placed in a small quantity of a dye indicator solution in a beaker at the boil. Agitate the fabric for 1 minute at the boil. Rinse cold until free from unfixed dyestuff. Then dab between filter papers and dry at room temperature.

The orange coloration indicates a fully cured fabric whereas green coloration indicates a partial cure (under-cure).

TABLE VIII

| | Degree of curing determined using BASF indicator solution after curing 20 seconds at | | | |
|---|---|---|---|---|
| Pad bath | 163° C. | 177° C. | 190° C. | 205° C. |
| (a) | + | ++ | +++ | +++ |
| (b) | – | + | ++ | +++ |
| (c) | – | + | ++ | +++ |
| (d) | – | ++ | +++ | +++ |

TABLE VIII-continued

| | Degree of curing determined using BASF indicator solution after curing 20 seconds at | | | |
|---|---|---|---|---|
| Pad bath | 163° C. | 177° C. | 190° C. | 205° C. |
| (e) | + | ++ | +++ | +++ |

+++ Very good
++ Good
+ Moderate
– Poor

From the data it can be seen that the products of this invention (a) are capable of curing even at relatively low temperatures unlike the methylolated carbamates (b+c) and have much the same reactivity as the dimethylol DHEU (d+e).

We claim:

1. A finish for textiles containing cellulose, which comprises an aqueous solution of from 30 to 70 percent strength by weight of a mixture of the conventionally methylolated derivatives of carbamates I and II

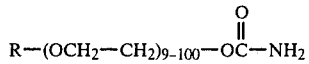

I

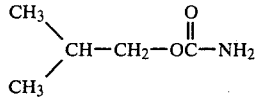

II where R is hydrogen or alkyl of 1 to 4 carbon atoms in the weight ratio I:II of from 1:1 to 1:20.

2. A process for the preparation of a textile finish as claimed in claim 1 by reacting a glycol or an alkylglycol of the formula III $$R\text{-}(OCH_2\text{-}CH_2)_{9\text{-}100}OH \qquad \text{III}$$

where R has the above meaning, and isobutanol with urea at above 100° C. so as to eliminate ammonia and produce carbamates, and methylolation with formaldehyde, wherein, in a first stage, the glycol or alkylglycol of the formula III is reacted to the extent of at least 50% with urea, in the absence of a catalyst, at from 130° to 160° C., to give the carbamate I, and in a second stage, carried out either in the presence of an ion exchanger containing nickel ions at from 130° to 165° C. or in the absence of a catalyst at from 150° to 200° C., the carbamate mixture in the weight ratio I:II of from 1:1 to 1:20 is prepared by addition of isobutanol and further urea.

3. A process for the easy-care finishing of textiles containing cellulose by impregnating the same with an aqueous solution containing 2.5 to 10% by weight, calculated as solids, of a crosslinkable finishing agent and 0.6 to 4% by weight of an acid or potentially acid catalyst and fixing by heating for from 10 seconds to 15 minutes at from 100° to 230° C., using the finishing agent claimed in claim 1.

* * * * *

UNITED STATES PATENT AND TRADEMARK OFFICE

CERTIFICATE OF CORRECTION

PATENT NO. : 4,314,806

DATED : February 9, 1982

INVENTOR(S) : H. Petersen; P.S. Pai; and M. Reichert

It is certified that error appears in the above—identified patent and that said Letters Patent is hereby corrected as shown below:

On the first page, second column, line 3

"methyloloated" should read --methylolated--.

Signed and Sealed this

*Third* Day of *August 1982*

[SEAL]

*Attest:*

GERALD J. MOSSINGHOFF

*Attesting Officer*

*Commissioner of Patents and Trademarks*